United States Patent [19]

Maeba

[11] 4,454,608

[45] Jun. 12, 1984

[54] AUDIO RESPONSE APPARATUS

[75] Inventor: Kazuhiko Maeba, Hadano, Japan

[73] Assignee: Hitachi, Ltd., Tokyo, Japan

[21] Appl. No.: 311,885

[22] Filed: Oct. 15, 1981

[30] Foreign Application Priority Data

Oct. 17, 1980 [JP] Japan ..... 55-146405
Mar. 25, 1981 [JP] Japan ..... 56-42326
Mar. 25, 1981 [JP] Japan ..... 56-42327

[51] Int. Cl.[3] ..... G10L 1/00

[52] U.S. Cl. ..... 381/51; 381/107; 340/347 DA

[58] Field of Search ..... 179/1 SM, 1 VL, 1 P; 340/148; 364/513, 513.5; 381/51-53, 107

[56] References Cited

U.S. PATENT DOCUMENTS 3,641,496 2/1972 Slavin ..... 179/1 SM
4,282,404 8/1981 Tanimoto et al. ..... 179/1 SM
4,346,364 8/1982 Takagi et al. ..... 179/1 SM

*Primary Examiner*—E. S. Matt Kemeny
*Attorney, Agent, or Firm*—Antonelli, Terry & Wands

[57] ABSTRACT

Prestored volume level data in a speech synthesis system controls the reference voltage to the resistor-divider network of the D/A converter to provide a volume-controlled output speech signal.

5 Claims, 5 Drawing Figures

AUDIO RESPONSE APPARATUS

The present invention relates in general to an audio response apparatus. In more particular, the invention concerns controlling volume level of audio or speech signals produced by a speech synthesizer through synthesis of audio parameters.

Recently, audio information processing techniques are much developed and made use of in practical applications in the field of information processing systems and in particular in terminal equipments. In brief, the speech or audio information processing of this kind is realized on the basis of the principle that audio waveform information stored in a memory on a word base or a monosyllable base are read out from the memory in the order as required and synthesized into speech signals.

As the speech synthesizing processes, there have hitherto been well known LPC (Linear Predictive Coding) method and PARCOR (Partial Auto-Correlation Coefficient) method. The former is based on the conception of periodic difference and linear prediction and is discussed, for example, by Atal, Schroeder et al in an article "Predictive Coding of Speed Signals" *The 6-th International Congress on Acoustics,* 1968.

The PARCOR method is an improvement of the LPC, according to which the audio waveforms are considered as the output signal produced when a system exhibiting whole polar type spectra is excited by random inputs, wherein the spectra are predicted statistically with the highest probability. For example, a typical one of the PARCOR method is discussed by Itakura, Saito et al in an article "PARCOR Type Analog Speech Synthesizer", *Acoustical Society of Japan,* (1970, October).

The synthesis of the audio information through the PARCOR method is very effective. Recently, there have been developed audio response apparatus in which a LSI circuit for the speech synthesis based on the PARCOR principle is used. In general, the audio response apparatus comprises a controller which is constituted by a microcomputer, a synthesizer for realizing the speech synthesis and a memory for storing information to be synthesized which information is referred to as the audio parameters, wherein the audio parameters are synthesized into audio or speech signals which are transformed by a loud speaker into an audible signal after having undergone a digital-to-analog conversion. A typical example of such speech synthesizer is disclosed by Richard and Brantingham "Three-chip System Synthesizes Human Speech" *Electronics,* 1978, Aug. 31, pp. 109–116.

In the audio response apparatus of this type, there is a demand for varying the volume level of the audible speech signal to be generated, because varying the volume level of the speech output can attract the attention of the audience, for example by increasing the volume level for important and/or emergency information. To meet such demand, it is known that volume control information may be additionally imparted to each of the audio parameters, so that the volume of the audio or speech signal to be synthesized can be variably controlled in accordance with the added information. However, this approach is disadvantageous in that the capacity of the memory for storing the audio parameters is necessarily increasing due to the accompanying storage of the volume control information, also leading to a considerable increase in the cost of the audio response apparatus.

It is apparently possible to vary the volume of the output speech signal by manually manipulating a variable resistor for volume control as is the case in television and radio receivers. However, such manual control needs a manual operation and is not efficient.

Accordingly, an object of the present invention is to provide an audio response apparatus in which audio or speech signal as produced can be freely controlled and varied in volume level.

Another object of the present invention is to provide an audio response apparatus which is capable of varying freely the volume level of audio or speech output signal without increasing the capacity of the memory for storing therein the audio parameters and without requiring manual control.

In view of the above object, there is provided according to a feature of the present invention an audio response apparatus which comprises a memory for storing audio parameters for use in synthesis of audio or speech signals, a controller, and a speech synthesizer which is supplied with audio parameters required for the speech synthesis from the memory under control of the controller and produces synthesized audio or speech signals, wherein circuit means is additionally provided for controlling volume level of the synthesized audio or speech signal in accordance with a volume control information supplied from the controller. The speech synthesizer is so arranged as to synthesize digital audio signals from audio parameters and to generate analog speech signal by digital-to-analog conversion of the digital audio signals, while the circuit means mentioned above is adapted to vary a reference voltage of the digital-to-analog converter in accordance with the volume control information supplied from the controller. The volume control information is supplied to the digital-to-analog converter from the controller every time the volume level is to be changed. There is no necessity to provide the volume control information in correspondence to every audio parameter. Accordingly, the capacity of the memory for storing the audio parameters needs not be increased for the storage of the control information, while it is assured that the volume of the audible signal can be variably controlled.

The present invention will be apparent from the following detailed description taken in conjunction with the accompanying drawings, in which.

In the following, the invention will be described in detail in conjunction with exemplary embodiments shown in the accompanying drawings.

Figure 1:
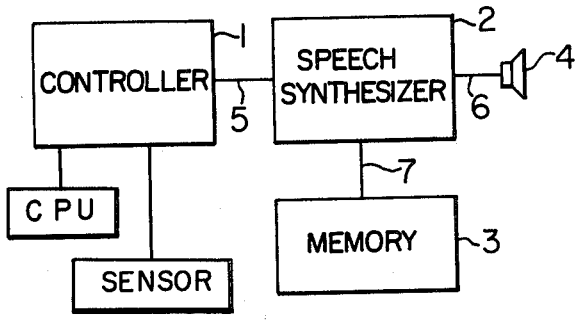
FIG. 1 is a block diagram for illustrating schematically a general arrangement of an audio response apparatus.

FIG. 1 shows schematically an arrangement of audio response equipment. In this figure, a controller 1 serves to control operation of the whole system and may be constituted by a microcomputer, for example. A memory unit 3 stores numerous audio parameters and may be constituted by a read-only memory (ROM), for example. A speech synthesizer 2 performs synthesis of speeches on the basis of audio parameters read out from the memory 3 under the control of command or control information produced from the controller 1. To this end, the speech synthesizer 2 includes digital filters and performs the speech synthesis in accordance with the known PARCOR (partial auto-correlation coefficient) technique. The synthesized speech signal is transformed into an audible output signal from a loud speaker 4.

In more particular, leading address information on required audio parameters, volume control information and speech generation initiating command are sequentially outputted from the controller 1 and supplied to the speech synthesizer 2 through a line 5. These informations are generated upon reception of instructions from a central processing unit connected to the controller 1 through a transmission line and/or of detected information from sensors connected to the controller 1.

For example, when the controller 1 accepts the instructions from the central processing unit, it discriminates the instructions and generates a volume control information based on the predetermined importance or emergency of the instruction, for example by using an importance table of instructions. The new volume control information is compared with the latest volume control information set in a registor of the speech synthesizer 2 to be described later. If coincidence is detected, the new volume control information is not supplied to the speech synthesizer 2. On the other hand, if coincidence is not detected, the new volume control information substitutes the volume control information in the speech synthesizer.

At the same time, the leading address of the audio parameters corresponding to the instructions is outputted from an instruction/leading address correspondence table provided in the controller 1. The leading address information is supplied to the memory 3 through a line 7 for preparation to read out the required audio parameters. The volume control information is processed in a characteristic manner according to the present invention. The volume control information sent out from the controller 1 is placed or loaded into a register provided in the speech synthesizer.

When the voice generation initiating command is inputted to the speech synthesizer 2, the necessary audio parameters are read out from the memory 3 in accordance with the address information supplied in precedence and then fed to the speech synthesizer 2 by way of the line 7. The speech synthesizer synthesizes a corresponding speech signal from the audio parameters fed from the memory 3. At that time, volume level of the speech signal is controlled in accordance with the volume control information placed in the register described below. After the volume level having been controlled or adjusted, the speech signal is finally outputted from the speech synthesizer 2 to the speaker 4 through the line 6, to be converted into a corresponding audible voice or speech message.

Next, description will be made in more detail on the volume control performed in the speech synthesizer 2 by referring to FIG. 2. In this figure, a referece numeral 17 denotes the register mentioned above which is loaded with the volume control information from the controller 1 by way of signal lines 25, 26 and 27. A reference numeral 24 denotes a digital-to-analog (or D/A) converter which constitutes the final stage of the speech synthesizer 2. A digital filter circuit (not shown) is provided in precedence to the D/A converter 24 for producing a digital speech signal synthesized from the audio parameters in accordance with the known PARCOR technique. The digital speech signal output from the digital filter circuit (not shown) is supplied to the input of the D/A converter 24 through a signal line 37 to thereby be converted into a corresponding analog speech signal which is then supplied to the speaker 4 through the line 6. The level of the analog speech signal (and hence the volume of the speech or voice produced from the speaker 4) is controlled in a variable manner in dependence on a reference voltage $E_0$ applied to an input terminal labelled as ADJ of the D/A converter 24.

The reference voltage $E_0$ is prepared in accordance with the output signal from the register 17 in a circuit constituted by an operational amplifier 23 and resistors 18 to 22. More particularly, the register 17 has output lines 28, 29 and 30 in which resistors 18, 19 and 20 are inserted, respectively. These resistors 18, 19 and 20 are connected in parallel to one another and commonly connected to a negative or minus (−) input terminal of the operational amplifier 23 and at the same time to a resistor 22 and coupled to the input terminal ADJ of the D/A converter 24. The operational amplifier 23 has a positive or plus (+) input terminal which is grounded to earth through a line 33, a resistor 21 and a line 31. Additionally, the operational amplifier 23 has a line 34 connected to a power source terminal 15 and a line 35 connected to a ground terminal 16.

The circuit of the arrangement described above is a sort of arithmetic circuit, the reference voltage $E_o$ of which is given by the following expression:

$$E_o = -\left(\frac{R_4}{R_1}\cdot E_1 + \frac{R_4}{R_2}\cdot E_2 + \frac{R_4}{R_3}\cdot E_3\right) \quad (1)$$

where $R_1$, $R_2$, $R_3$ and $R_4$ represent resistances of the resistors 18, 19, 20 and 22, respectively, while $E_1$, $E_2$ and $E_3$ represent, respectively, voltages appearing on the individual bit output lines 28, 29 and 30 of the register 17.

When selection is made such that $R_1=R_2=R_3=R_4$, the expression (1) can be simplified as follows:

$$E_o = -(E_1 + E_2 + E_3) \quad (2)$$

Further, because each of the output voltages $E_1$, $E_2$ and $E_3$ of the register 17 is either 0(V) or +E(V), the reference voltage $E_0$ given by the expression (2) is either one of 0(V), −E(V), −2E(V) and −3E(V).

By the way, a reference numeral 21 denotes a correcting resistor for an input bias current, and the resistance $R_5$ of this resistor 21 is usually selected such that $R_5 \cong R_1 \cong R_2 \cong R_3 \cong R_4$.

With the circuit arrangement described above, the audio parameters are read out from the memory 3 and fed to the speech synthesizer 2 under the control of the controller 1. Simultaneously or in precedence, three-bit volume control information is produced from the controller 1 and placed in the register 17. Each of the output voltages $E_1$, $E_2$ and $E_3$ from the register 17 is controlled to be 0(V) or +E(V) in dependence on whether the volume control information is logic "0" or "1", whereby the reference voltage $E_0$ produced by the operational amplifier 23 and supplied to the D/A converter 24 is controlled to be variable. In the case of the illustrated embodiment, since the reference voltage $E_0$ can be varied at four levels of 0(V), −E(V), −2E(V) and −3E(V), the volume level of the analog speech signal outputted from the D/A converter 24 can be controllably varied also at four levels or steps.

For example, when a message of no particular importance, for example, is to be produced as a corresponding speech, volume control information of "001" may be produced from the controller 1, resulting in that the corresponding speech signal is produced from the speaker 4 at the volume level of −E(V). Various speeches produced from the speaker 4 remain at the same level until the volume control information sotred in the register 17 is varied. Assuming now that such situation arises in which an emergency or alarm message is to be issued, then the controller 1 will output the volume control information of "111", for example, which is set at the register 17. As the consequence, the corresponding speech produced from the speaker 4 will be at the volume level of −3E(V).

Next, another exemplary embodiment of the present invention will be described by referring to FIG. 3. In this connection, it should be mentioned that the audio response of a same or constant level (or volume) may be perceived subjectively at different levels (or volumes) in dependence on the environmental conditions (noises) or individual audience. Hence, the audio response apparatus according to this exemplary embodiment of the invention is so constituted that the level control may also be externally effected. In FIG. 3, the same elements as those shown in FIG. 2 are denoted by the same reference numerals and symbols.

Figure 2:
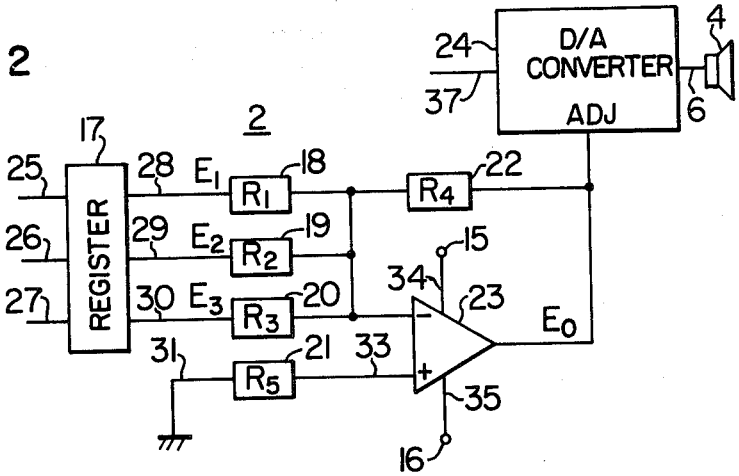
FIG. 2 is a circuit diagram illustrating a typical volume control circuit implemented in a speech synthesizer shown in FIG. 1 according to an embodiment of the invention.
Figure 3:
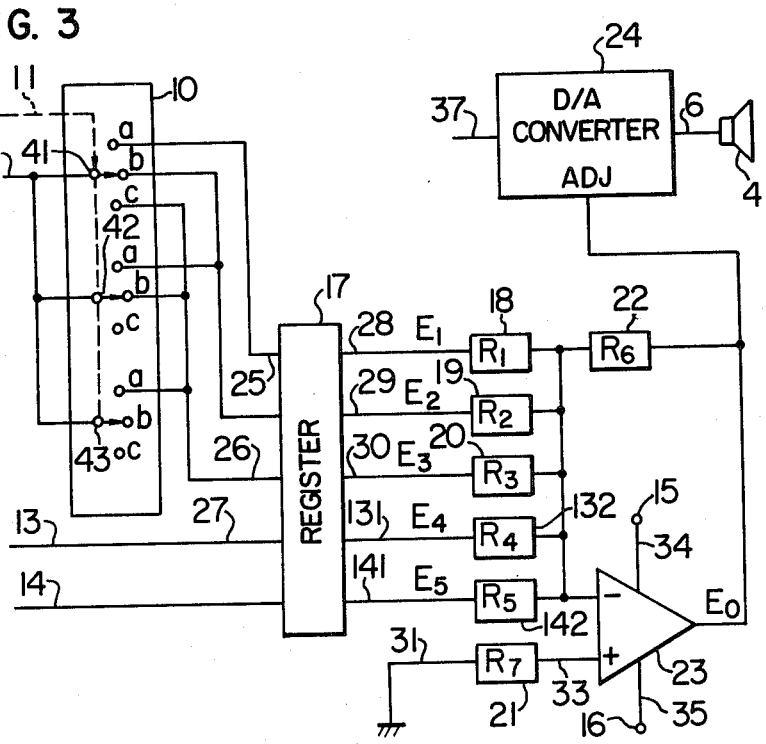
FIG. 3 is a circuit diagram showing the volume control circuit according to another exemplary embodiment of the invention.

Now, referring to FIG. 3, the volume control information transmitted from the controller 1 (FIG. 1) through the signal line 12 is finally set or placed in the register as in the case of the apparatus shown in FIG. 2. The embodiment illustrated in FIG. 3 differs from the one shown in FIG. 2 in that the volume control information is processed by a specific circuit before being loaded in the register 17. In more particular, a volume level selector circuit 10 is provided to select the volume control information supplied through the signal line 12 at three steps in response to an external command or instruction supplied through a command line 11. Such external command signal may be derived from output of a sensor (noise sensor), for example. If the change-over circuit 10, individual level switching circuits 41, 42 and 43 are interlocked one another in operation. For example, the switch position represented by a may correspond to the position at which the volume level is to be further increased. The position labelled b may correspond to the position at which the volume level should conform to the volume control information supplied from the controller 1. Finally, the position labelled c may correspond to the position at which the volume level should be slightly lowered. Thus, the volume control information outputted from the volume level change-over circuit 10 is fed through the switch output lines 25, 26 and 27 with additional output lines 13 and 14 to the register 17 in a form of five-bit information.

The digital-to-analog or D/A converter 24 which constitutes the final stage of the speech synthesizer 2 is implemented in the circuit configuration similar to the one described above in conjunction with FIG. 2. The digital speech signal is inputted to the D/A converter 24 through the signal line 37 to be converted into a corresponding analog speech signal which makes appearance on the output line 6. The level of the analog speech output signal (and hence the volume of the speech produced by the speaker 4) can be varied or adjusted in dependence on the reference voltage $E_0$ supplied to the input terminal ADJ of the D/A converter 24.

The reference voltage $E_0$ is prepared in accordance with the output from the register 17 in a circuit which is composed of the operational amplifier 23 and resistors 18 to 22, 132 and 142. This circuit may be realized as an arithmetic circuit, wherein the reference voltage $E_0$ can be given by the following expression:

$$E_o = -\left(\frac{R_6}{R_1}\cdot E_1 + \frac{R_6}{R_2}\cdot E_2 + \frac{R_6}{R_3}\cdot E_3 + \frac{R_6}{R_4}\cdot E_4 + \frac{R_6}{R_5}\cdot E_5\right) \quad (3)$$

where $R_1$, $R_2$, $R_3$, $R_4$, $R_5$ and $R_6$ represent the resistances of the resistors 18, 19, 20 132, 142 and 22, respectively, while $E_1$, $E_2$, $E_3$, $E_4$ and $E_5$ represent, respectively, the voltages appearing at the bit output lines 28, 29, 30, 131 and 141 of the register 17. When selection is made such that $R_1=R_2=R_3=R_4=R_5=R_6$, the expression (3) can be simplified as follows:

$$E_o = -(E_1 + E_2 + E_3 + E_4 + E_5) \quad (4)$$

Since each of the output voltages $E_1$, $E_2$, $E_3$, $E_4$ and $E_5$ from the register 17 is either 0(V) or +E(V), the reference voltage $E_0$ given by the expression (4) is either one of 0(V), −E(V), −2E(V), −3E(V), −4E(V) or −5E(V).

The resistor 21 serves for correcting the input bias current and the resistance $R_7$ thereof is usually selected such that $R_7 \cong R_1 \cong R_2 \cong R_3 \cong R_4 \cong R_5 \cong R_6$.

The volume control information outputted from the controller 1 are supplied through the lines 12, 13 and 14. The volume control information appearing on the line 12 is destined to set the volume level at a level "1" which corresponds to the level of −2E(V) of the reference voltage $E_0$ supplied to the D/A converter 25. The volume control information signal appearing on the line 13 serves to set the volume level at a level "2" which corresponds to the level −3E(V) of the reference voltage $E_0$. At this time, the same signal makes appearance at the line 12. The volume control information signal appearing on the line 14 is destined to set the volume at a level "3" which corresponds to the reference voltage $E_0$ of the level −4E(V). At the time, the same signal makes appearance also at both lines 12 and 13.

On the other hand, the volume level selector circuit 10 may be supplied with a switching command signal through the external control line 11, when the level information for setting the volume level "1", "2" or "3" is supplied from the controller 1, as described below.

For example, it is first assumed that the selector circuit 10 is set at the switch position a. Under the assumption, when the volume control information corresponding to the volume level "1" is sent from the controller 1, then the line 12 is turned on while the lines 13 and 14 remain in the off-state. Consequently, the input bits supplied to the register 17 through the lines 25, 26 and 27 are "ON" or "1's", while the input bits supplied through the lines 13 and 14 are "OFF" or "0's". As the consequence, the reference voltage $E_0$ is at the level of $-3E(V)$, whereby the speech is produced from the speaker 4 at the volume level "2" defined above. When the volume control information corresponding to the volume level "2" is supplied from the controller 1, the lines 12 and 13 are turned on, while the line 14 remains off. Consequently, the input bits to the register 17 through the lines 13, 25, 26, 27 are "1's", while the bit input through the line 14 is "0". Thus, the reference voltage $E_0$ is set at the level of $-4E(V)$. In a similar manner, upon application of the volume control information corresponding to the volume level "3" from the controller, the reference voltage $E_0$ of $-5E(V)$ is produced.

Next, it is assumed that the selector circuit 10 is set at the switch position c. On the assumption, when the volume control information corresponding to the volume level "1" is supplied from the controller 1, only the bit input line 27 to the register 17 becomes "ON" or "1", while the bit lines 13, 14, 25 and 26 remain "OFF" or "0". As the consequence, the reference voltage $E_0$ is set at $-E(V)$, whereby a speech is produced from the speaker 4 at a lower volume level than the volume level "1" defined above. When the volume control information corresponding to the volume level "2" defined above is supplied from the controller 1, then the reference voltage $E_0$ is set at $-2E(V)$, whereby the speech output from the speaker 4 is produced at a level corresponding substantially to the volume level "1" defined above. In the utterly similar manner, upon application of the volume control information corresponding to the volume level "3" defined above, the reference voltage $E_0$ is set at $-3E(V)$, resulting in the speech output from the speaker 4 at a volume level corresponding substantially to the volume level "2" defined hereinbefore.

Only when the selector circuit 10 is at the switch position b, the speech output can be obtained with the volume level which literally corresponds to the volume control information supplied from the controller 1 without being altered in the manner described above.

In this way, the value or level of the reference voltage $E_0$ applied to the digital-to-analog or D/A converter 24 can be varied in accordance with the output information from the register 17 which in turn is determined in dependence on the volume control information supplied from the controller 1 and the switch position of the volume level selector circuit 10.

In other words, in the case of the illustrative embodiment shown in FIG. 3, the level of the analog speech signal outputted from the D/A converter 24 can be varied at six steps or levels in dependence on the volume control information with the aid of the volume level selector circuit 10.

It goes without saying that the number of steps for varying the volume level can be further increased, by correspondingly increasing the number of the output bits from the register 11 with the number of the input circuits for the operational amplifier 23 being correspondingly increased. This can be easily accomplished by increasing the number of the resistors connected in parallel to one another and connected commonly to the negative (−) input terminal of the operational amplifier 23.

Next, a further examplary embodiment of the present invention will be described by referring to FIGS. 4 and 5. It is contemplated with this illustrative embodiment of the audio response apparatus that the indication be given as to the level at which a speed or voice message is being produced or the level at which a completed voice message has been generated. In this connection, it should be recalled that even a voice message produced at a consistent volume level may subjectively be perceived with different sensitivities in dependence on the environmental conditions such as noises or other influential factors. Accordingly, it is desirable to make available such visually perceivable information which allows the output volume level to be re-adjusted in dependence on the environmental conditions and/or degree of importance of the speech information, so that the auditorily missed voice message may be produced again on the basis of determination made with the aid of the displayed level information.

Figure 4:
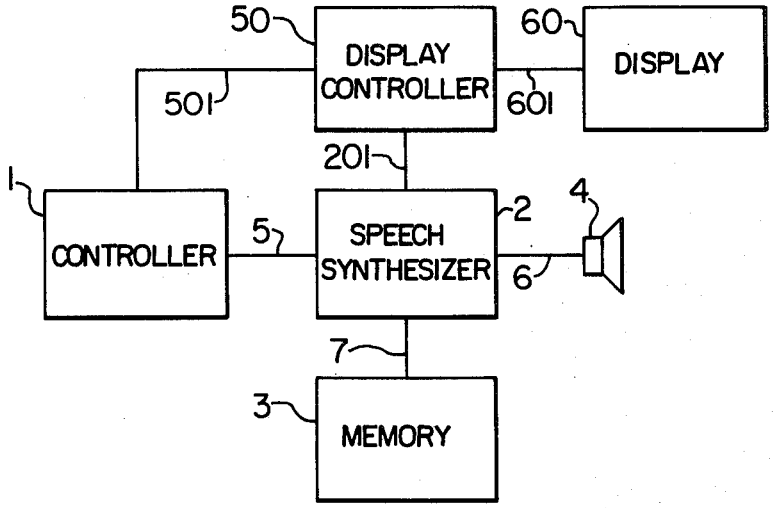
FIG. 4 is a block diagram to illustrate schematically another audio response apparatus to which a further embodiment of the invention can be applied.

Referring to FIG. 4, the audio response apparatus schematically shown therein differs from the one shown in FIG. 1 in that a display controller 50 and a display unit 60 are additionally provided. As can be seen from FIG. 4, the display controller 50 is supplied with a control signal from the controller 1 through a line 501 and a volume control information from the speech synthesizer 2 through a line 201. The contents of the volume control information is transmitted to the display unit 60 through a line 601 to be displayed at a predetermined area.

Figure 5:
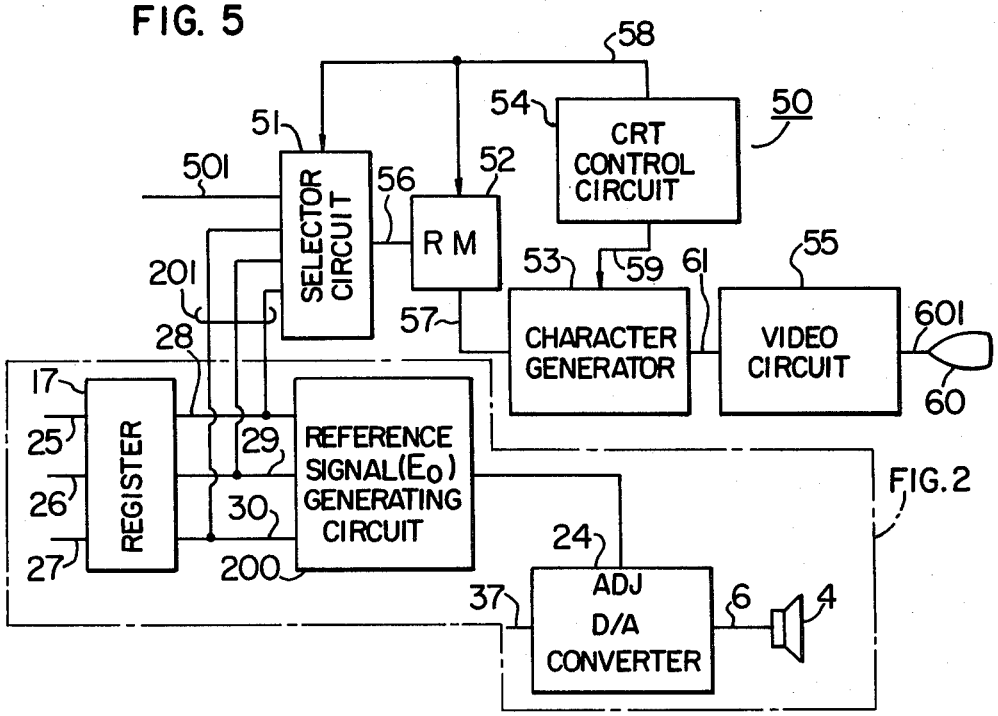
FIG. 5 is a block diagram of the volume control circuit and a display control circuit implemented in the speech synthesizer shown in FIG. 4 in accordance with a further embodiment of the invention.

In more particular, reference is made to FIG. 5 in which the same elements as those shown in FIGS. 2 and 4 are denoted by the same reference numerals and symbols. In substance, the circuit arrangement shown as enclosed by a single-dot broken line block corresponds to the circuit shown in FIG. 2, and the display controller 50 is additionally provided. In this conjunction, it is to be noted that a circuit 200 shown in FIG. 5 corresponds to the circuit composed of the resistors 18 to 22, the operational amplifier 23 and others shown in FIG. 2 may be referred to as the reference signal generating circuit for generating the reference signal $E_0$. Repeated description of the circuit arrangement corresponding to the one shown in FIG. 2 will be unnecessary. The volume control information set in the register 17 through the signal lines 25, 26 and 27 are derived as the outputs through the signal lines 28, 29 and 30 which are connected to a selector circuit 51 through signal lines denoted generally by a reference numeral 201. The selector circuit 51 serves to convert the level information placed in the register 17 into corresponding character codes to be displayed. The character codes are written in a refresh memory 52 through the line 56. Other character signals to be displayed are supplied to the selector circuit 51 from the controller 1 through a line 501 and written in the refresh memory 52 through the line 56.

The contents stored in the refresh memory 52 is controlled by a display or CRT control circuit 54 through a line 58, whereby the character codes are sequentially supplied to a character generator 53 through a line 57. Under the control through a line 59, the character codes to be displayed are converted into dot pattern information which is then supplied to a video circuit 55 through a line 61. The video circuit 55 allows corresponding dot patterns to be sequentially produced on the display 60 through a line 601, thereby to display characters, while the contents in the register 17 is displayed at a predetermined area or location of the display 60.

With the arrangement described above, it is possible to know at which level the voice message is being produced in the audio response or at which level a completed voice message has been produced, whereby information as to whether the volume level is to be readjusted in dependence on the environmental conditions is obtained.

In the foregoing, a few exemplary embodiments of the invention have been disclosed. However, it should be appreciated that the invention is never restricted to the disclosures but variations and modifications are conceivable without departing from the scope of the invention. For example, in the case of the exemplary embodiment described by referring to FIG. 2, the operational amplifier is employed with a view to making it possible to increase or decrease the number of the input circuits and/or to realize the circuit in a facilitated manner. However, it is obvious that the operational amplifier may be replaced by any other circuits or combination of transistors so far as they allow the output voltage $E_0$ to be varied in accordance with the input voltages $E_1$ to $E_i$.

What is claimed is:

1. An audio response apparatus for producing analog audio signals, comprising:

(a) a memory for storing therein digital audio parameters which are to be read out during the production of the analog audio signals;

(b) a controller for setting at least address information of said memory and sound volume control information;

(c) a speech synthesizer for synthesizing digital audio signals from the audio parameters read out from said memory in accordance with the address information designated by said controller;

(d) a digital-to-analog converter for converting said digital audio signals from said speech synthesizer into analog signals as a function of a variable reference voltage, said variable reference voltage controlling the conversion of said digital signals to analog signals including the level of the analog signal in the digital-to-analog converter;

(e) a register for temporarily loading the sound volume control information derived from said controller; and (f) control means for varying the reference voltage supplied to said digital-to-analog converter in a plurality of steps on the basis of the sound volume control information from said register to control the digital to analog conversion of the audio signal and the level of the audio signal.

2. An audio response apparatus for producing analog audio signals, comprising:

(a) a memory for storing therein digital audio parameters;

(b) a speech synthesizer for synthesizing digital audio signals from the audio parameters read out from said memory;

(c) a digital-to-analog converter for converting said digital audio signals into analog audio signals as a function of a variable reference voltage, said variable reference voltage controlling the conversion of said digital signals to analog signals including the level of the analog signal in the digital-to-analog converter; and (d) control means for varying the reference voltage supplied to said digital-to-analog converter to control the digital to analog conversion of the audio signal and the level of the audio signal.

3. An audio response apparatus for producing analog audio signals according to claim 2, wherein said control means includes register means for temporarily loading digital control information for controlling sound volume, and an arithmetic operation means for producing said reference voltage for said digital-to-analog converter on the basis of said digital control information from said register means.

4. An audio response apparatus for producing analog audio signals according to claim 3, further including means for setting said digital control information to said register means by means other than said control means.

5. An audio response apparatus for producing analog audio signals according to claim 3, further including display means for visually displaying said digital control information outputted from said register means.

* * * * *